US005179600A

United States Patent [19]

Bailey et al.

[11] Patent Number: 5,179,600

[45] Date of Patent: Jan. 12, 1993

[54] EXPANDABLE INSERT FOR SOFT LUGGAGE ARTICLES SUCH AS BACKPACKS AND THE LIKE

[75] Inventors: J. Trevor Bailey, Palatine; Mark A. Crone, Mt. Prospect, both of Ill.

[73] Assignee: ERO Industries, Morton Grove, Ill.

[21] Appl. No.: 804,634

[22] Filed: Dec. 10, 1991

[51] Int. Cl.[5] ..... A45C 7/00

[52] U.S. Cl. ..... 383/127; 383/33; 190/106; 150/900

[58] Field of Search ..... 383/33, 35, 104, 119, 383/127; 190/106; 150/130, 900

[56] References Cited

U.S. PATENT DOCUMENTS

| | | | |
|---|---|---|---|
| 2,283,406 | 5/1942 | Bacon . | |
| 2,766,926 | 10/1956 | Thompson | 383/119 X |
| 2,802,617 | 8/1957 | Roper | 383/119 X |
| 3,074,617 | 1/1963 | Kindseth et al. | 383/119 X |
| 3,300,166 | 1/1967 | Wojciechowski . | |
| 3,447,648 | 6/1969 | Schwennicke . | |
| 4,077,451 | 3/1978 | Zoland . | |
| 4,141,399 | 2/1979 | Zoland . | |
| 4,142,564 | 3/1979 | Zoland . | |
| 4,434,894 | 3/1984 | Lee . | |
| 4,946,292 | 8/1990 | Diamond et al. . | |
| 4,969,751 | 11/1990 | Diamond et al. . | |
| 4,993,846 | 2/1991 | Diamond et al. . | |
| 5,030,014 | 7/1991 | Diamond et al. . | |

FOREIGN PATENT DOCUMENTS

| | | | |
|---|---|---|---|
| 1150742 | 4/1969 | United Kingdom | 383/34 |

*Primary Examiner*—Stephen P. Garbe
*Assistant Examiner*—Jes F. Pascua
*Attorney, Agent, or Firm*—Lockwood, Alex, FitzGibbon & Cummings

[57] ABSTRACT

An expandable insert for soft luggage articles, such as backpacks includes a pair of opposing planar insert panels interconnected by two web members. The web members may either be partially integrally formed from the insert panels or they may be separately formed. The web members are themselves also planar and each includes a foldline disposed therein between the opposing insert panels. At least one elastic band engages the two web members and provides an expansion force for the insert which draws the web members from a folded position into a generally planar position wherein they are generally perpendicular to the insert panels. The web members may include gusset portions which interconnect the web members to the insert panels.

26 Claims, 4 Drawing Sheets

EXPANDABLE INSERT FOR SOFT LUGGAGE ARTICLES SUCH AS BACKPACKS AND THE LIKE

BACKGROUND AND SUMMARY OF THE INVENTION

The present invention generally relates to soft luggage articles such as backpacks and, more particularly, to expandable inserts for such articles which assist in displaying such articles in their actual use configuration at points of sale.

A wide variety of soft luggage articles such as backpacks, sport bags, tote bags, and the like are presently successfully marketed to purchasers of all ages. These popular soft luggage articles are formed from a fabric, hence the name "soft". Typically these articles are shipped from the point of manufacture to the point of purchase in a flat or collapsed condition wherein the article fabric walls are collapsed upon each other. In a collapsed condition, a great number of the articles can be easily packaged in a single carton for shipment to points of purchase.

However, once the articles reach the point of purchase, it is desirable to display them in a "stuffed" or expanded condition wherein the article displays its entire shape. This stuffing is accomplished with material such as cardboard forms or crumpled paper. Stuffing imposes a labor burden on the retailer at the point of sale. In order to avoid burdening the retailer with such stuffing chores, the manufacturer can ship the articles in a stuffed condition. However, in a stuffed condition, the articles take up more room in the shipping cartons than if shipped in collapsed condition. Expandable inserts were developed to allow shipment of these articles in a flat condition. Expandable inserts are inserted into the articles after manufacture and the articles are collapsed. When the articles are removed from their shipping cartons at the retailer, the inserts expand within the article to display it in a stuffed condition. These inserts may be complex in design such as that described in U.S. Pat. No. 4,946,292 and its progeny, which include a exterior activation means such as a cord attached to the insert which must be pulled to induce the insert into its expanded form. Assembly of inserts with exterior activation means not only increases the cost of manufacture of the insert, but also requires labor to be performed by the retailer at the point of sale. Other inserts, as described in U.S. Pat. No. 4,993,846 issued Feb. 19, 1991 possess a construction in which opposing cardboard insert panels are expanded by a separately formed expander assembly wherein the expander assembly is formed separately from the insert panels. Such a construction requires that the expanded assembly be formed from an additional material in a separate step and therefore increases the cost of manufacture of the insert.

The present invention offers an improvement over the aforementioned inserts because it possesses a structure which does not rely upon an external activation means, such as a cord, and it may be formed from two sheets of an insert material to reduce the overall cost and complexity of manufacture of the insert.

In this regard, the present invention is directed to an expandable insert for an article of soft luggage which is formed from one or more sidewalls, such as a backpack, sport bag or tote bag in which the insert includes a pair of opposing insert panels which are interconnected by two bendable webs, wherein a first web is formed integrally from a central portion of a first insert panel and the second web is formed integrally from a central portion of the second insert panel. The central portions of the two insert panels may be die cut to define the webs. Each web has a base end attached to its associated insert panel and an opposite free end portion which is attached to the opposing insert panel by way of adhesive means or the like. Each web includes a generally central line of weakening, such as a crease or foldline, which permits the web to be folded upon itself when the insert is collapsed. The webs may or may not be integrally formed with their associated insert panels of origin. The webs are interconnected by an internal activation means, such as one or more elastic bands extending transversely to the webs which exert a force on the two webs and pulls them toward each other into an open, position, wherein the webs are parallel to each other and perpendicular to the insert panels to thereby provide the means necessary by which the insert panels expand against the sidewalls of the article. The webs may also include gusset portions integrally formed therewith which are attached to the insert panels to provide reinforcement to the webs in the overall assembly.

Accordingly, it is an object of the present invention to provide a expandable insert apparatus which is inserted into a soft luggage article and which permits the article to be retained in a collapsed, or flattened, state during packaging and shipment thereof and which insert apparatus expands outwardly against the walls of the article to expand the article when it is removed from a shipping carton or package.

Another object of the present invention is to provide an expandable insert for a backpack or similar soft luggage article which is inserted into a backpack at the point of manufacture and which expands against the walls of the backpack when the backpack is removed from a shipping carton at the point of purchase, which insert has an internal expansion activation means and which insert does not require an external restraint to maintain it in a position.

A further object of the present invention is to provide an expandable insert for a backpack which includes a pair of opposing insert panels interconnected by a pair of web panels, a first web panel being formed within a central portion within a first insert panel, the second insert panel being formed within a central portion of a second insert panel, the two webs being interconnected by elastic means which applies tension forces to the webs causing them to expand and thereby forcing the insert panels against the backpack walls.

Still another object of the present invention is to provide an expandable insert having first and second opposing endwalls an expander mechanism interconnecting the two endwalls, the expander mechanism including first and second web members spaced apart from each other, the first web member being integrally connected to the first endwall and the second web member being integrally connected to the second endwall, each of the two web members being connected to an opposing endwall of the insert, the web members further including a pair of parallel fold lines upon which the web members are folded upon themselves to permit the opposing end walls to be placed in a collapsed condition, the web members further including elastic activation means which causes the web members to be attracted to each other and thereby exert an outwardly expanding force upon the insert end walls.

These and other objects, features advantages of the present invention will be clearly understood through a consideration of the following detailed description.

BRIEF DESCRIPTION OF THE DRAWINGS

In the course of this detailed description, reference will be frequently made to the attached drawings in which.

DETAILED DESCRIPTION OF THE INVENTION

Figure 1:
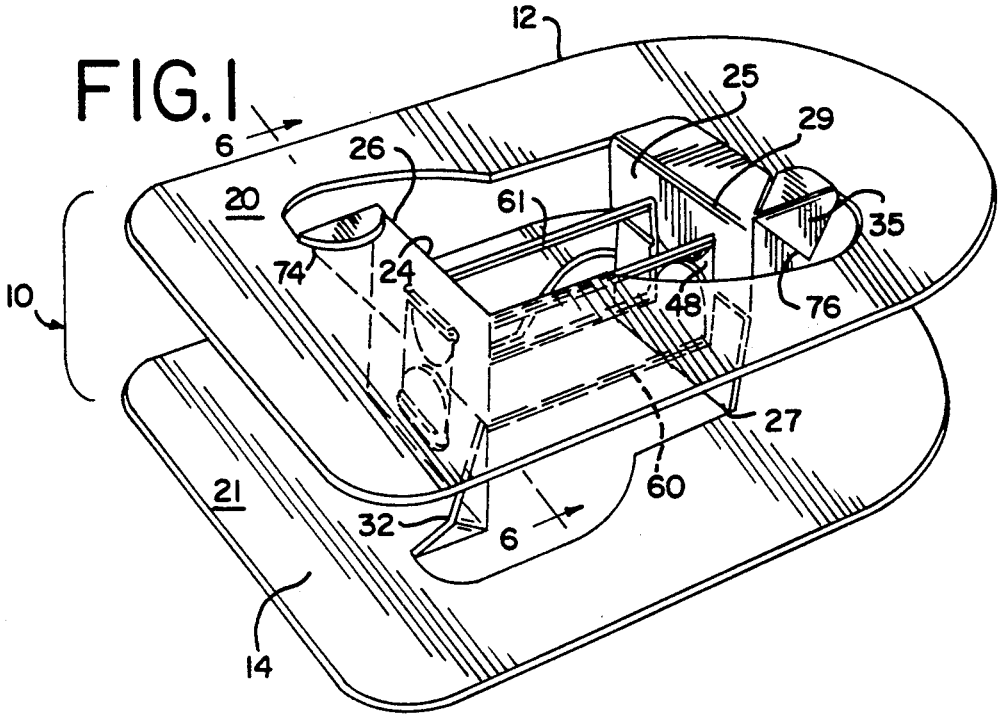
FIG. 1 is a perspective view of an expandable insert constructed in accordance with the principles of the present invention.

Turning now to FIG. 1, one embodiment of an expandable insert 10 constructed in accordance with the principles of the present invention is illustrated. The insert 10 is suitable for use in expanding articles of soft luggage such as purses, sport bags, tote bags, backpacks and the like. Although the present invention shall be described herein in a backpack environmental situation, it will be appreciated that the recurring use of the term "backpack" is intended only to be illustrative and not limiting in that the structure of the present invention is equally applicable to other types of soft-walled articles where it is desired to reduce the space they occupy when empty.

Figure 2:
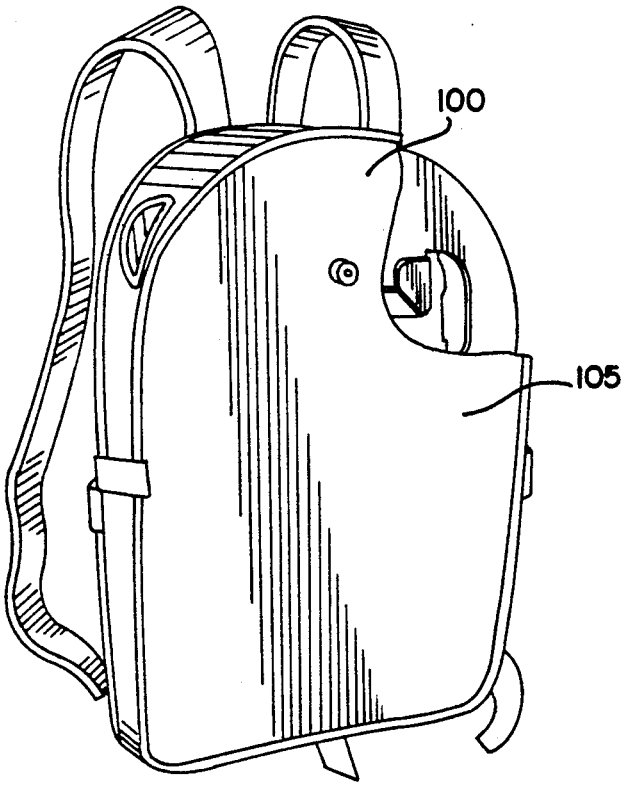
FIG. 2 is a perspective view partially in section, of a backpack in an expanded condition utilizing the insert of FIG. 1.
Figure 3:
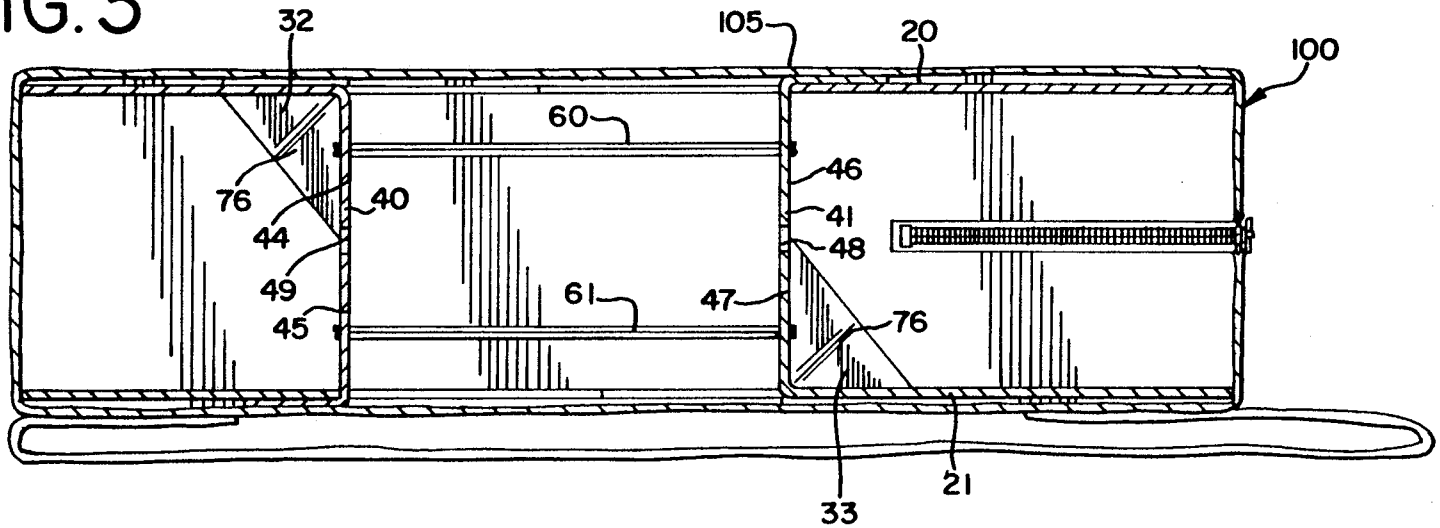
FIG. 3 is a sectional view of the backpack of FIG. 2 in an expanded position.
Figure 4:
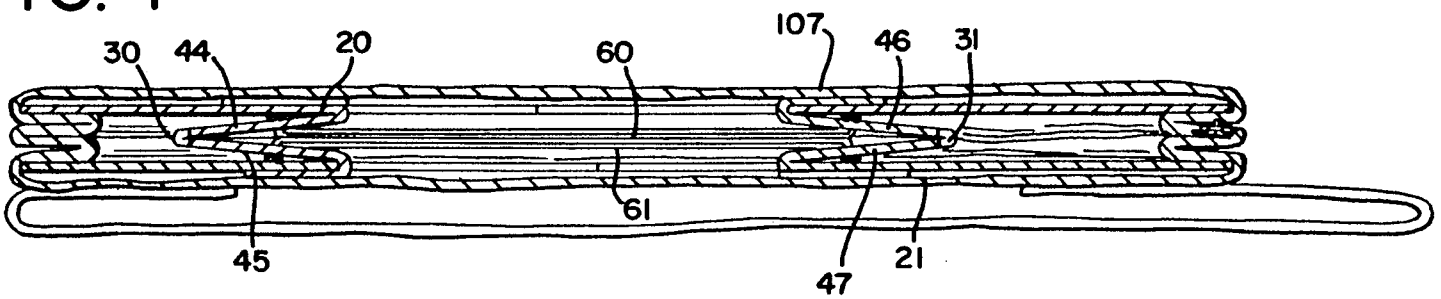
FIG. 4 is a sectional view of the backpack of FIG. 2 in a collapsed position.

The expandable insert 10 of FIGS. 1–6 is seen to be formed from two pieces 12, 14 of an insert material (FIG. 5) which can resist repeated collapse-expand cycles and which material is inexpensive and easily formed such as by die cutting. A suitable insert material is cardboard, and other relatively rigid materials, such as composition board and plastics may suffice. The insert 10 includes two endwalls, or insert panels 20, 21 which are generally planar in nature and which may be configured in a manner complementary to the configuration of the sidewalls of the article into which the insert 10 is placed, such as backpack 100. (FIGS. 2–4).

Figure 7:
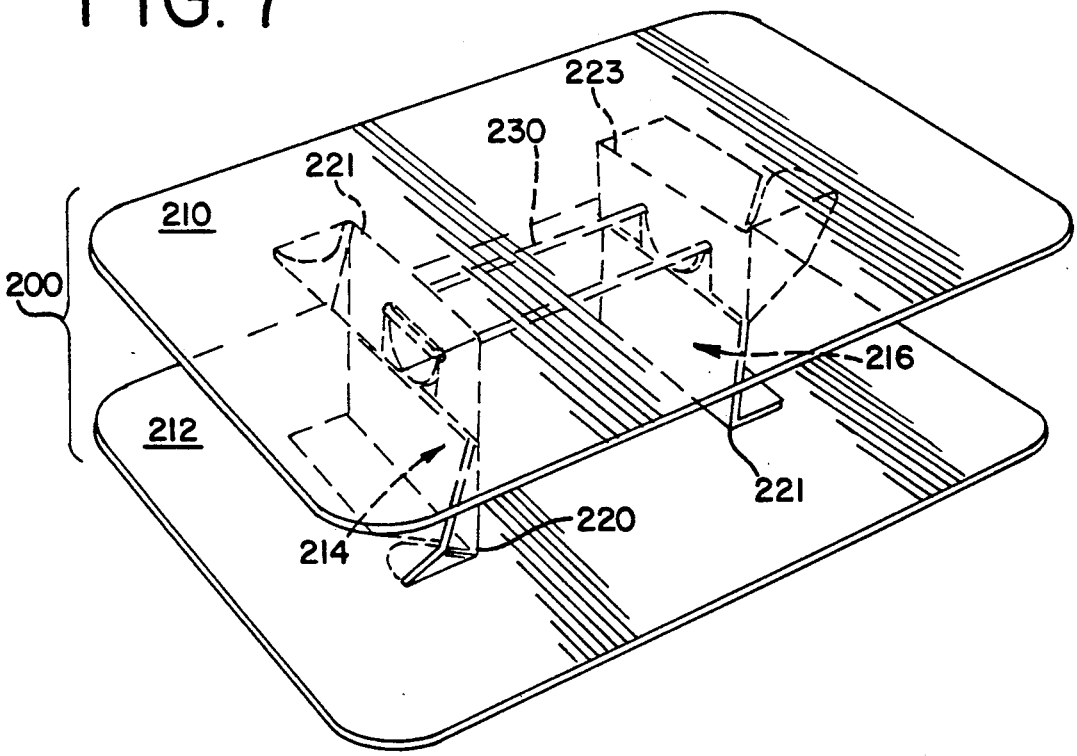
FIG. 7 is a perspective view of a second embodiment of an expandable device constructed in accordance with the principles of the present invention.

Each of the insert panels 20, 21 has a central portion 22, 23 from which respective first and second web members 24, 25 are formed. With more particular reference to FIGS. 5 and 6, the web members 24, 25 are die cut from their respective insert panels 20, 21 in a manner such that one end thereof serves as a base end 26, 27 for each web member. These base ends 26, 27 are defined by a foldline 30, 31 in each insert panel 20, 21. As shown in the Figures, the web member base ends 26, 27 are integrally formed with the insert panels 20, 21. Alternatively, as shown in FIG. 7, the web members 214, 216 may be formed separately from the insert panels 210 and 212, and suitably attached thereto. Because the web members 24, 25 are die cut within the insert panels central portions 22, 23, each web member includes a free end 28, 29 disposed thereon opposite the base ends thereof 26, 27. As will be explained in greater detail below, each of the web members 24, 25 may also include, for reinforcement purposes, a gusset portion 32–36 which are also die cut from the insert panel central portions 22, 23.

Figure 5:
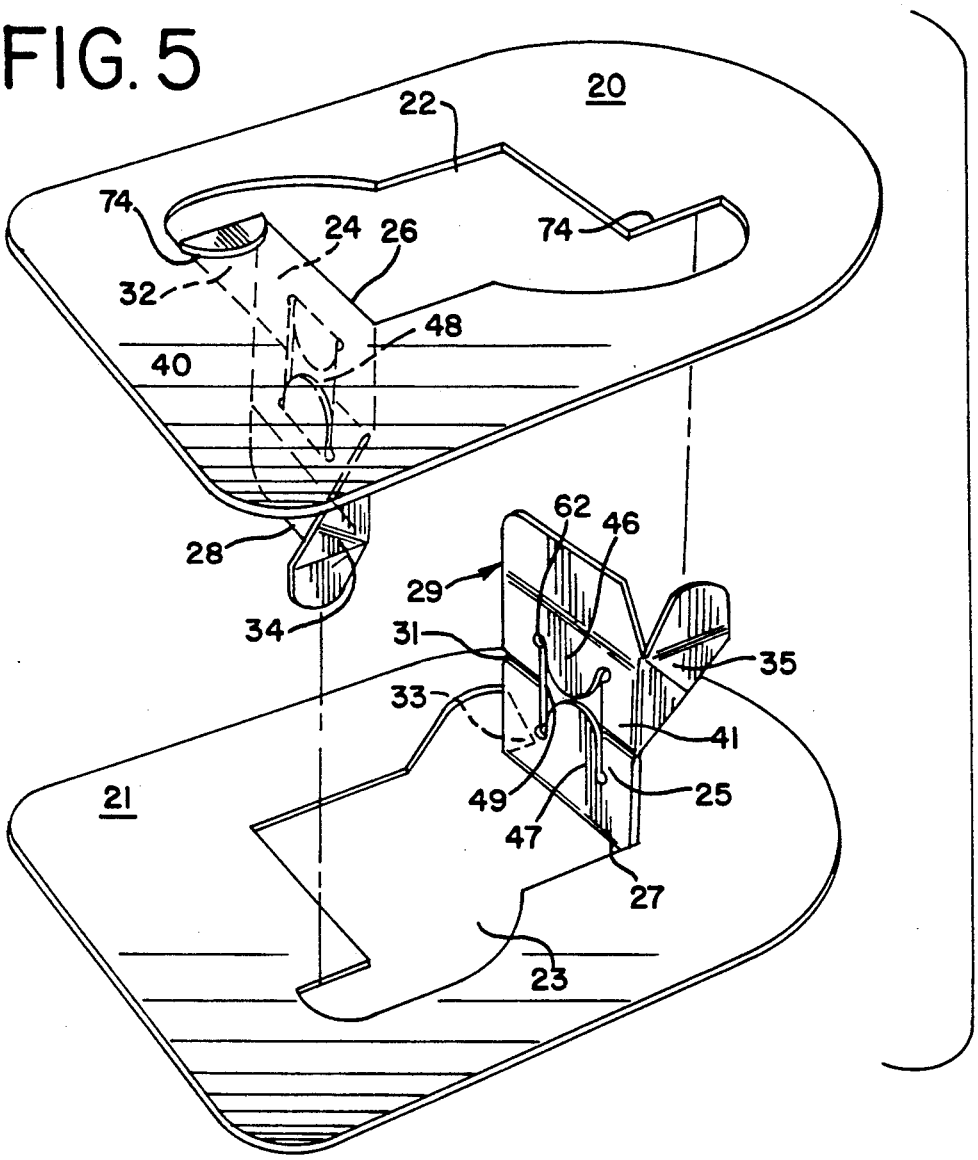
FIG. 5 is a exploded perspective view of the insert of FIG. 1.
Figure 6:
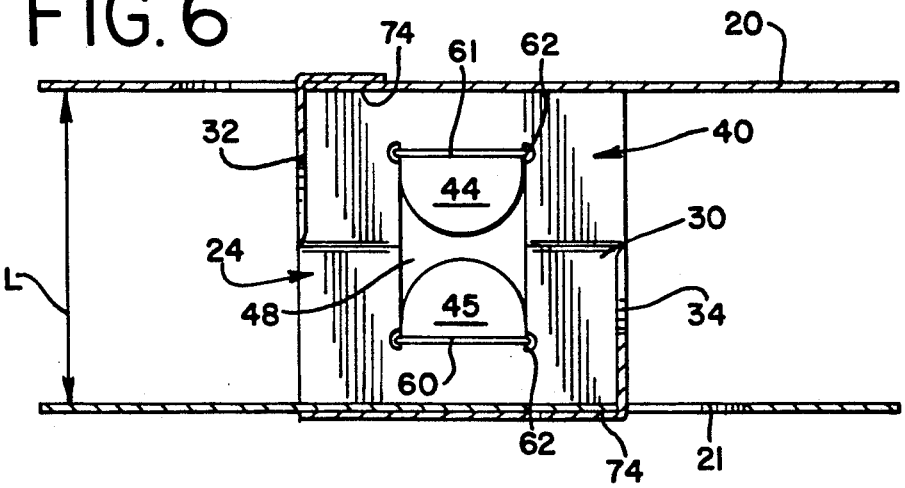
FIG. 6 is an elevational view taken along lines 6—6 of FIG. 1.

Returning to the web member structure, each web member 24, 25 includes an expansion portion 40, 41 disposed between the opposing base and free ends of the webs. Each expansion portion 40, 41 further includes a foldline, or crease, 30, 31 associated therewith and generally disposed in the center thereof upon which the web members 24, 25 and in particular, the expansion portions thereof 40, 41 may be folded upon themselves along the foldlines 30, 31 to compress or flatten the insert 10 when the article 100 it is inserted into, is prepared for shipment to a retailer. (FIG. 4) The expansion portions 40, 41 may also preferably include centrally located tongue members 44–47 which are defined by respective openings 48, 49. These tongue members 44–47 are instrumental in expanding the insert 10 into an expanded, or stuffed, position within the backpack 100 against the opposing sidewalls 105, 107 thereof when the backpack is removed from the shipping carton. (FIG. 5.) In this regard, an internal expansion activation means, such as one or more elastic bands 60, 61 engage respective opposing tongue members 44, 46 and 45, 47. These elastic bands 60, 61 serve to apply attraction forces to the opposed web members 24, 25, thereby causing them to be drawn toward each other until the web members are generally parallel to each other.

As shown best in FIG. 1, the elastic bands 60, 61 may pass through holes 62 formed on each side of the tongue members 44–47 within the openings 48, 49 to assist in retaining the elastic bands 60, 61 in place on the respective web members 24, 25. In instances where two elastic bands 60, 61 are utilized such as in the embodiment of FIGS. 1–6, they are preferably disposed in engagement with the associated tongue members 44–47 on opposite "halve" portions 70–73 defined in the web members 24, 25 by the intermediary associated foldlines 30 and 31.

FIG. 4 illustrates the insert 10 in place within a soft luggage article 100 in a flattened, or collapsed, condition. In such a condition, the insert panels 20, 21 are relatively closely spaced together in a parallel relationship, and when fully collapsed, the web members 24, 25 are folded upon themselves about their respective foldlines 30, 31 such that the web member halves are virtually in contact with each other and the insert panels 20, 21 all virtually occupy parallel planes. In such a collapsed condition, the web members 24, 25 and the tongue members 44–47 formed therein are displaced outwardly relative to a center of the insert 10. This outward movement places the elastic bands 60, 61 under tension. The elastic nature of the bands 60, 61 constantly exerts a force upon the opposing web members 24, 25 attracting them inwardly (relative to the center of the insert 10) toward each other. This attraction force is resisted by the outer walls of the shipping carton (not shown) and the pressure of adjoining articles when packed into the carton.

When the article 100 is removed from the shipping carton by the retailer at the point of sale, the tension of the elastic bands 60, 61 forces the web members 24, 25 to assume their generally planar configuration whereby the insert panels 20, 21 expand outwardly against the sidewalls of the article. (FIG. 3.) As seen the extent of expansion of the insert panels 20, 21 is limited by the length "L" of the web members. AS previously mentioned, the web members 24, 25 may also include one or more gusset portions 32–36 which not only reinforce the connection between the web member opposing ends 26–29 and the insert panels 20, 21, but also limit the movement of the web members 24, 25 relative to the insert panels 20, 21. In this regard, the gussets 32–36 serve to prevent the web members 24, 25 from being folded upon themselves inwardly relative to the center of the insert panels rather from outwardly or in a direction opposite that shown in FIG. 3. If such opposite folding were to occur, the elastic bands 60, 61 would not remain under tension in a collapsed state.

Each gusset 32–36 may be formed integrally with its associated web member 24, 25 (FIG. 5) extending away therefrom to a point of attachment 74 on the insert panels 20, 21. The gussets may each also contain an attachment flap 75 which provides a surface for suitable attachment to the insert panels 20, 21 such as by adhesives or fasteners. The gussets 32–36 also preferably contain a foldline 76 about which the gusset may be folded upon itself when the insert 10 is collapsed.

It can be seen best from FIG. 5 that, in the embodiment of FIGS. 1–6, the insert 10 can be easily formed from two generally similar insert panels, with the web members being die-cut from the insert panel central portions 22, 23, wherein the web members 24, 25 are integrally connected to the insert panels 20, 21 at the base end 26, 27 thereof. Such a structure saves on materials and assembly time.

Alternatively, as shown in the insert 200 of FIG. 7, the insert panels 210, 212 and web members 214, 216 may be formed from separate sheets of material. In such instances the web members 214, 216 are attached to the opposing insert panels 210, 212 by suitable attachment means such as by a permanent adhesive or by a separate fastener such as a staple or rivet at the web member opposing ends 220–223. Additionally, the insert 200 may rely only upon a single elastic band 230 to expand it outwardly.

It will be understood that the embodiments of the present invention which have been described are merely illustrative of a few applications of the principles of the invention. Numerous modifications may be made by those skilled in the art without departing from the true spirit and scope of the invention.

We claim:

1. An expansion apparatus for use in an article of soft luggage of the type having a collapsed condition and an expanded condition, the apparatus comprising:

a first planar insert panel for bearing against a first sidewall of the article, a second planar insert panel for bearing against a second sidewall of said article, an expansion assembly disposed between the first and second insert panels, the expansion assembly including first and second web members, the first web member extending from a central portion of said first insert panel and being attached to a central portion of said second insert panel, the second web member extending from said second insert panel and being attached to said first insert panel central portion, said first and second web members each including at least one gusset portion, the gusset portion extending from said respective first and second web members to said respective first and second insert panels, said apparatus further including means for activating said expansion apparatus from between a first, collapsed position within said article wherein said first and second insert panels are disposed relatively closely together to a second, expanded condition with said article wherein said first and second insert panels are spaced a preselected distance apart from each other, the activating means including at least one elastic member, the preselected distance being equal to a common length of said first and second web members, such that, when said expansion apparatus is in said second, expanded condition, said first and second insert panels are generally parallel to each other.

2. The expansion apparatus of claim 1, wherein said first web member has a base portion which is integrally formed with said first insert panel central portion and said second web member has a base portion which is integrally formed with said second insert panel central portion.

3. The expansion apparatus of claim 2, wherein said first web member includes a free end disposed opposite its base portion, the first web free end being adhesively attached to said second insert panel central portion.

4. The expansion apparatus of claim 2, wherein said second web member also includes a free end disposed opposite its base portion, the second web free end being adhesively attached to said first insert panel central portion.

5. The expansion apparatus of claim 2, wherein said first web member includes a free end disposed opposite its base portion, and said second web member includes a free end disposed opposite its base portion, the first web free end portion being adhesively attached to said second insert panel central portion and the second web free end being adhesively attached to said first insert panel central portion.

6. The expansion apparatus of claim 1, wherein said elastic member includes an elastic band, and each of said first and second web members includes an slot therein defining a tongue portion of said first and second web member, said elastic band engaging said first and second web tongue portions, said elastic band further being disposed in a plane generally parallel to said first and second insert panels.

7. The expansion apparatus of claim 1, wherein said activating means includes tow elastic bands, and said first web member includes an opening disposed therein which defines two opposing tongues of said first web member, said second web member also including an opening therein defining two opposing tongues of said second web member, one of said two elastic bands engaging one tongue of said first web member and one tongue of said second web member, the other of said two elastic bands engaging the other of said first web two tongues and the other of said second web two tongues, each of said two elastic bands being disposed in a plane generally parallel to said first and second insert panels.

8. The expansion apparatus of claim 1, wherein said first and second web members are formed from respective first and second insert panels central portions.

9. The expansion apparatus of claim 1, wherein said first web member is formed from said first insert panel central portion, said first web member having a base portion and a free end disposed at opposite ends thereof, said first web base portion being integrally connected to said first insert panel and said first web free end being adhesively connected to said insert panel, and wherein said second web member is formed from said second insert panel central portion, said second web member also having a base portion and a free end disposed at opposite ends thereof, said second web base portion being integrally connected to said second panel said second insert panel and said second web free end being adhesively connected to said first insert panel.

10. The expansion apparatus of claim 9, wherein first and second web members each further include a foldline disposed between said web base portions and said web free ends, said foldline permitting said first and second web members to be folded upon themselves when said expansion apparatus is in said first collapsed position.

11. The expansion apparatus of claim 10, wherein said first and second web member foldlines are generally disposed along the center of said first and second web members, said foldlines further defining a plane which is generally parallel to said first and second insert panels when said expansion apparatus is in said second expanded position.

12. The expansion apparatus of claim 10, wherein said first and second web members each include a slot therein which defines at least one tongue portion in each of said first and second web members, said elastic means engaging said first and second web tongue portions, said elastic means further urging said expansion apparatus into said second expanded position by exerting a force on each of said first and second web members.

13. The expansion apparatus of claim 9, wherein said first web member includes at least one gusset portion integrally formed therewith, said gusset extending from said first web member to said second insert panel, said gusset portion being adhesively attached to said second insert panel, said gusset portion further including a foldline which permits said gusset portion to fold upon itself when said expansion apparatus is in said first, collapsed position.

14. The expansion apparatus of claim 1, wherein each of said web members includes a foldline, said at least one gusset portion limiting movement of said web members about said foldlines when said expansion apparatus is in said second, expanded position.

15. The expansion apparatus of claim 1, wherein at least one of said first and second insert panels has a configuration generally the same as one of said article first or second sidewalls.

16. The expansion apparatus of claim 1, wherein each of said first and second web members include at least one gusset portion integrally formed therewith, said gusset portions extending from said first and second web members and joined to said first and second insert panels by attachment means.

17. The expansion apparatus of claim 1, wherein each of said first and second web members are attached to said first and second insert panels by attachment means.

18. The expansion apparatus of claim 1, wherein each of said first and second web members include a foldline disposed within said web members, said foldline separating each of said first and second web members into separate havles, whereby said first and second web portion member havles are generally parallel to said insert panels when said expansion apparatus is in said first, collapsed position and said first and second web member halves are generally perpendicular to said insert panels when said expansion apparatus is in said second, expanded position.

19. An expanding device for an article such as a backpack having a compartment defined by at least two opposing flexible sidewalls, the device capable of expanding the backpack when inserted into the backpack compartment from a collapsed position to an expanded position, said device comprising, in combination: a pair of opposed insert panels, the insert panels being interconnected by two webs, each of the two webs having a foldline disposed therein between points of attachment of said webs to said insert panels, said two webs being folded upon themselves about said foldlines when said device is inserted into said backpack compartment and said backpack is collapsed, said two webs further including at least one elastic member engaging said two webs and extending between said two webs the two webs each including a tab, the elastic member engaging said tabs, such that said elastic member is in tension when said device is in said collapsed position, and wherein said opposing insert panels are in a general parallel relationship, said elastic member urging said device into said expanded position by applying forces to said two webs, whereby said two webs are unfolded about said web foldlines and said webs are disposed generally perpendicularly to said insert panels and said insert panels assume a generally parallel, spaced-apart position, each of said webs including at lest one gusset portion extending between said webs and said insert panels, said gusset portions limiting movement of said webs about said web foldlines.

20. The expanding device of claim 19, wherein said elastic member includes tow elastic bands.

21. The expanding device of claim 19, wherein each of said two webs are formed from central portions of respective insert panels.

22. The expanding device of claim 19, wherein each of said two webs includes a free end, each of said free ends being attached to said insert panels by attachment means.

23. The expanding device of claim 22, wherein said attachment means includes adhesive means.

24. The expanding device of claim 19, wherein said elastic member includes two elastic bands spaced apart and extending between said webs.

25. An expanding insert assembly for use in an article carrier having at least one article carrying compartment defined by two opposing sidewalls of the carrier, said carrier being of the type having a collapsed condition and an expanded condition, the insert assembly comprising:

a first planar insert panel for bearing against one of the two opposing sidewalls of said carrier, a second planar insert panel for bearing against another of said two opposing sidewalls of said carrier, an expansion component disposed between the first and second insert panels, the expansion component including first and second webs, the first web having a base integrally formed with a central portion of the first inset panel and the second web portion have a base integrally formed with a central portion of the second insert panel, said first web further being attached to said second insert panel central portion, said second web further being attached to said first insert panel central portion, said apparatus further including elastic means for activating said expansion component from between a first, collapsed position within said article carrier wherein said first and second insert panels are disposed relatively closely together to a second, expanded condition within said article carrier wherein said first and second insert panels are spaced a preselected distance apart from each other which is equal to a common length of said first and second webs, such that, when said expansion component is in said second, expanded condition, said first and second insert panels are generally parallel to each other, said first and second webs each further including at least one gusset integrally formed therewith, said gussets extending from said first and second webs to said first and second insert panels and being joined thereto by attachment means.

26. An expansion apparatus for use in an article of soft luggage of the type having a collapsed condition and an expanded condition, the apparatus comprising;

a first planar insert panel for bearing against a first sidewall of the article, a second planar insert panel opposing the first insert panel for bearing against a second sidewall of said article, an expansion assembly disposed between said first an second insert panels, the expansion assembly including first and second web members, the first web member extending from a central portion of said first insert panel and a being attached to a central portion of said second insert panel, the second web member extending from said second insert panel and being attached to said first insert panel central portion, said apparatus further including means for activating said expansion apparatus from between a first, collapsed position within said article wherein said first and second insert panels are disposed relatively closely together to a second, expanded condition within said article wherein said first and second insert panels are spaced a preselected distance apart from each other in the form of at least one elastic member, the preselected distance being equal to a common length of said first and second web members, such that, when said expansion apparatus is in said second, expanded condition, said first and second insert panels are generally parallel to each other, said first and second web members each further including a foldline, the foldline permitting said web members to be folded upon themselves when said expansion apparatus is in said first collapsed position, said apparatus further including means for limiting movement of said first and second web members about said web foldlines when said expansion apparatus is in said second, expanded position.

* * * * *